United States Patent [19]

Guionie et al.

[11] Patent Number: 4,472,857

[45] Date of Patent: Sep. 25, 1984

[54] STOP DEVICE, IN PARTICULAR FOR AN AUTOMOTIVE VEHICLE DOOR

[75] Inventors: Paul Guionie, Larche; René Roudier, Brive, both of France

[73] Assignee: Paumellerie Electrique, Larche, France

[21] Appl. No.: 357,670

[22] Filed: Mar. 12, 1982

[30] Foreign Application Priority Data

Mar. 13, 1981 [FR] France ..... 81 05043

[51] Int. Cl.[3] ..... E05D 11/08

[52] U.S. Cl. ..... 16/341; 16/344; 16/345; 16/363; 16/385

[58] Field of Search ..... 16/328, 337, 341, 344, 16/345, 352, 363, 385

[56] References Cited

U.S. PATENT DOCUMENTS 3,837,042 9/1974 White ..... 16/385 X

FOREIGN PATENT DOCUMENTS 2478177 10/1978 France .

2439285 10/1978 France .

*Primary Examiner*—Mark Rosenbaum

*Assistant Examiner*—Joseph M. Gorski

*Attorney, Agent, or Firm*—Robert E. Burns; Emmanuel J. Lobato; Bruce L. Adams

[57] ABSTRACT

In the door stop, the arm which is pivotally mounted on the door has the shape of a flat strip against the respective edges of which strip are applied under elastically yieldable pressure two rollers. The first roller, which, in the open position of the door, is engaged in a stop notch, is fixed in position, whereas the other roller is rotatably mounted on a transverse portion of a stirrup which connects adjacent end portions of two helical windings of a torsion spring. Each roller comprises two rings which are fitted one inside the other and have a sliding contact between each other, with the pins on which they are mounted, with the arm and with inner faces of a bracket carrying the pins.

3 Claims, 5 Drawing Figures

STOP DEVICE, IN PARTICULAR FOR AN AUTOMOTIVE VEHICLE DOOR

DESCRIPTION

The present invention relates to a stop device, in particular for a pivotal door of an automotive vehicle, comprising an arm pivotally mounted on one of two elements consisting of the door and a fixed post on which the door is mounted, said arm having the shape of a strip having two opposed edges against which edges are applied two rollers, one of which rollers is fixed in position whereas the other is movable and subjected to an elastically yieldable action which creates a pressure of contact between each of the two rollers and the arm, the arm being provided with a stop notch for retaining said fixed roller in the open position of the door.

In known door stop devices of this type, the rollers employed are solid rollers which, as they are subjected to wear which is unavoidable especially as they are exposed to dust and weather, require a periodical greasing, otherwise the stop device would become inoperative within a relatively short period of time.

An object of the invention is consequently to provide a door stop device which may have a long life without any greasing being necessary.

The invention accordingly provides an arrangement in which each roller comprises two cylindrical rings which are fitted one inside the other, each of said rings having at one end a planar radially outwardly extending flange, the flange of the inner ring having such radial dimension that it projects from the cylindrical surface of the outer ring so that a sliding contact can occur, not only radially between the two rings but also axially between the flanges and the respective outer faces of the arm.

Owing to the presence of two rings, if one thereof is prevented from rotating, for example owing to a seizure, the other ring ensures the rotation without disturbing the operation of the device. Further, the lateral guiding of the pivotal arm in contact with the inner face of the flanges of the respective rings, prevents any friction of this arm with the adjacent elements of the bracket such as the side walls or branches between which the rollers may be mounted. In respect of such adjacent elements, the contact occurs exclusively on the outer face of the flanges.

The two rings are advantageously provided with a surface coating of a sliding varnish made from a material having a low coefficient of friction, such as polytetrafluoroethylene.

Endurance tests carried out under normal conditions of utilization encountered in practice on a door stop device comprising rollers consisting of two rings provided with a sliding varnish and devoid of grease, show that it was possible to obtain, after 50,000 pivotal movements of the arm, a satisfactory operation of the device. This is a remarkable performance if it is considered that, under the same conditions, it was not possible to exceed 5,000 pivotal movements of the arm with conventional solid rollers.

The invention will be described in the ensuing description with reference to the accompanying drawings, in which.

These Figures show the invention in its application to a vehicle door, but it will be understood that the stop device may be employed for other pivotal closing means of the vehicle, such as the bonnet of the engine, the luggage compartments, a hatch or like door, or even in other types of device, for example for the lids of household apparatus, suit cases, chests and other devices. The expression "door" must be employed in a very broad sense to designate these various pivotal closing means.

Figure 1:
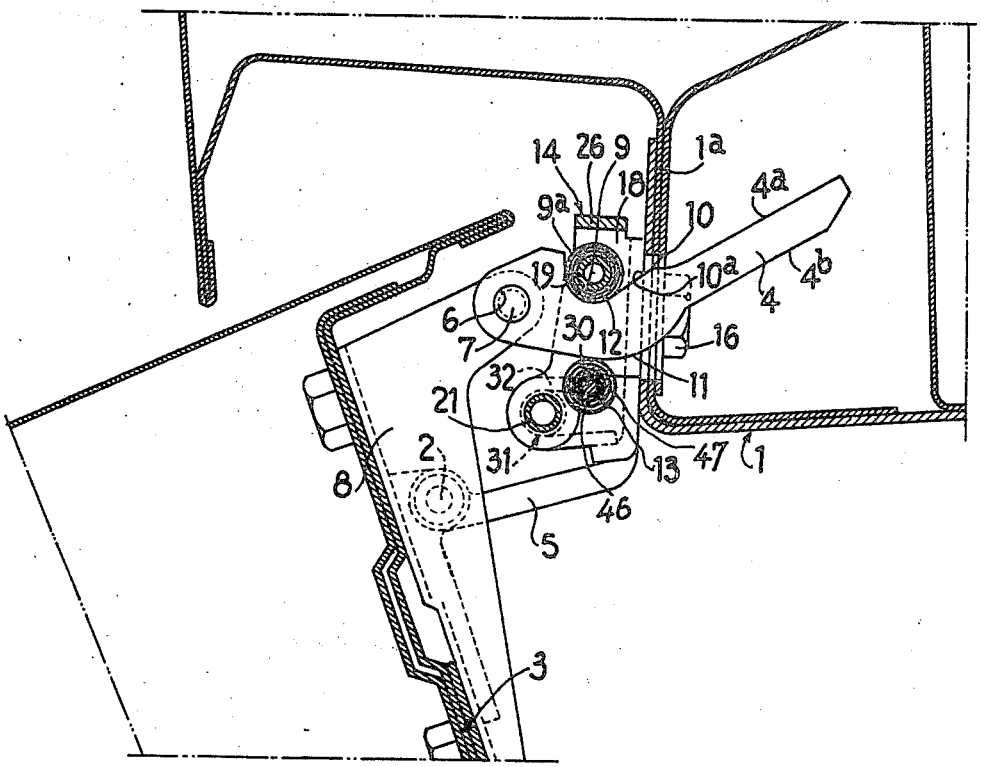
FIG. 1 is a vertical sectional view of a door stop device comprising a pivotal arm and two rollers which bear against the respective edges of the arm.

FIG. 1 shows a body post 1 on which the left front door 3 is pivotally mounted by means of hinges whose hinge pin 2 extends through two hinge parts 5 which are fixed to the post 1 and the door 3 respectively. The door is retained in an open position by a stop device which comprises an arm 4 in the form of a flat strip having adjacent one end an aperture 6 through which a pivot pin 7 extends parallel to the pin 2 and rigid with a fork member 8 fixed to the door 3. In the vicinity of this end, the arm 4 has on its front edge **4*a* a stop notch 9 in which is engageable, in the position corresponding to the end of the opening of the door, a roller 12 carried by a bracket 14 which is secured by bolts 16 to one of the sheet metal parts 1*a* constituting the post 11 that the arm 4 extends through. The front edge 4*a* of the arm 4 is urged against the roller 12 which is fixed in position, by an opposed roller 13 which is also carried by the bracket 14 and biased by an elastically yieldable torque against the rear edge 4*b* of the arm 4**.

The bracket 14 is in the general shape of a plate defined by two large planar wing portions 17 which have a shape which is approximately that of a quadrilateral and are applied against the sheet **1*a* and are provided with apertures 17*a* for the passage of fixing bolts 16. The two wing portions 17 extend symmetrically on each side of a U-shaped centre portion 15 which is produced by a folding operation and has two planar branches 18 which are perpendicular to the wing portions and uniformly spaced from the plane of symmetry X—X and provided for the mounting of two pins 19, 21. One of the pins acts as a journal for the fixed roller 12 and the other pin extends distinctly beyond the branches of the U-shaped portion 15 and forms two extensions 27 which extend adjacent to the respective wing portions 17. A helical winding 28 is engaged on the two extensions and has a free end portion which is anchored against an L-shaped flange 29 of the corresponding wing portion 17 and is part of a torsion spring 31 whose central portion forms a stirrup which connects, through a transverse element 30, the adjacent end portions of the two windings. Rotatably mounted on the transverse element which constitutes a journal 30 is the roller 13 which is thus subjected to the elastically yieldable torque produced by the spring 31**.

The transverse portion 26 of the centre U-shaped portion 15 is roughly perpendicular to the wing portions 17 and is located adjacent the edge of the latter so that the arm 4 can move between the branches 18 without any interference from the transverse portion 26 from which it is always spaced.

Figure 5:
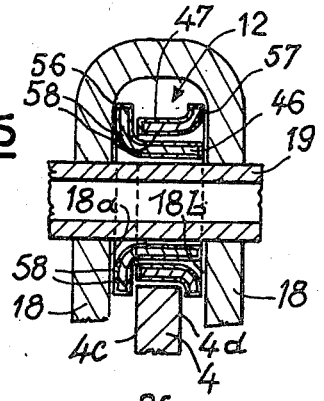
FIG. 5 is a sectional view of the construction of the rollers, each of which comprises two sliding rings.
Figure 2:
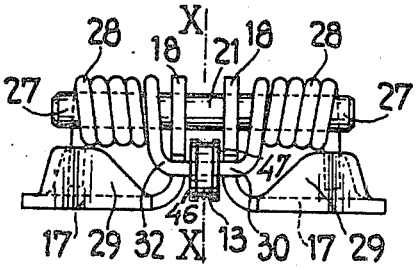
FIGS. 2, 3 and 4 are respectively an end elevational view, a plan view and a side elevational view, of a bracket supporting the two rollers and fixed to the fixed post with respect to which the door is pivotally mounted.
Figure 3:
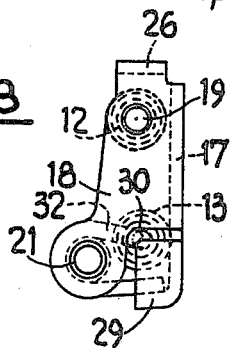
Figure 4:
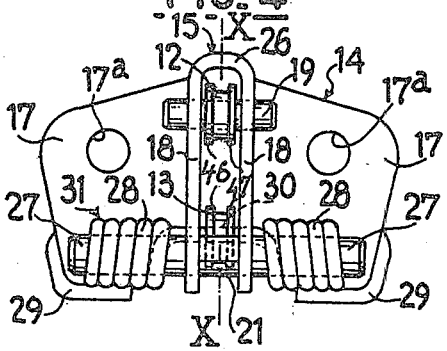

According to the invention, and as shown to an enlarged scale in FIG. 5, each of the rollers 12, 13 comprises two cylindrical rings of treated steel 46, 47. Each ring has at one end a planar, radially outwardly extending flange 56, 57. The rings are fitted one inside the other. The radial dimension of the flange 56 of the inner ring 46 is such that it projects radially beyond the cylindrical surface of the outer ring 47. The two rings have consequently a radial sliding contact between their adjacent cylindrical surfaces and may also have an axial sliding contact between the end devoid of a flange of the outer ring 47 and the flange 56 of the inner ring. A coating 58 of polytetrafluoroethylene, or of another material having a low coefficient of friction, is applied on the surface of the two rings. 46, 47 in order to improve the sliding characteristics, not only between two rings, but also between the inner ring 46 and the pin 19 or the element 30, and between the flanges 56, 57 and, on one hand, the inner faces 18*a*, 18*b* of the branches 18 of the bracket 14, and, on the other hand, the lateral faces 4*c*, 4*d* of the pivotal arm 4.

Under the action of the torque exerted by the transverse portion 30 of the spring 31, the two rollers 12 and 13 are applied forcefully against the edges 4*a*, 4*b* of the arm 4 in the closed position (not shown). The two rollers bear against a rectilinear portion of the edges 4*a*, 4*b* so that the torque to be exerted to open the door is very low. Toward the end of the opening travel, the rollers 12, 13 must respectively pass over the boss 10 having an angular contour formed on the edge 4*a* and the region 11 having a convex curvature of the edge 4*b*, before the roller 12 finally enters the stop notch 9 which positively retains it by the end side 9*a* as shown in FIG. 1. In order to close the door starting at this fully opened position, a relatively large torque must be exerted in opposition to the retaining action exerted by the adjacent ramp 10*a* of the boss 10.

The rollers 12, 13 having a double ring 46, 47 have been illustrated and described hereinbefore as applied to a particular embodiment of a door stop device which is disclosed in French patent application No. 80 05870. However, it will be understood that these rollers comprising a double ring may be employed in any door stop device comprising a pivotal arm on the edges of which are applied two opposed rollers, in which case the inner faces of the flanges 56, 57 have a sliding contact with the lateral faces of the arm with reduced friction owing to the fact that the flanges undergo a rotational movement under the effect of the displacement of the arm.

The arrangement proposed by the invention is particularly advantageous when each roller is mounted between two parallel planar surfaces against which surfaces the outer faces of the flanges 56, 57 have a sliding contact. Thus the roller according to the invention may be employed in the door stop device disclosed in French Pat. No. 78 29777.

Having now described our invention, what we claim as new and desire to secure by Letters Patent is:

1. In a stop device for a pivotal door, said device comprising an arm for pivotally mounting on a first element of two elements consisting of a door and a fixed post on which the door is pivotally mounted, a bracket for fixing on a second element of said elements, a first roller structure and a second roller structure, journal means respectively rotatively mounting both the roller structures on the bracket, said arm having a shape of a strip and defining two opposed edges against which edges are applied said two roller structures, said first roller structure being fixed in position and said second roller structure being movable relative to said bracket, means for elastically yieldably biasing the movable roller structure against said arm so as to create a contact under pressure between each of the two roller structures and said arm, said arm defining a stop notch for retaining the fixed roller structure in an open position of the door; the improvement in which each roller structure comprises an inner cylindrical ring and an outer cylindrical ring, the inner cylindrical ring being rotatively mounted inside the outer cylindrical ring and on said journal means therefor, each ring having at an end of said each ring an outer cylindrical surface and including a planar radially outwardly extending flange, the flange of the inner ring having such radial dimension that it projects radially beyond said outer cylindrical surface of the outer ring so that a sliding contact can occur radially between the two rings and also axially between the flanges and respective outer faces of the arm.

2. A device according to claim 1, comprising a coating of a material having a low coefficient of friction on the two rings in portions of the two rings which are in sliding contact with another surface.

3. A device according to claim 1 or 2, wherein the bracket comprises two spaced-apart planar branches, between which branches the roller structures are mounted, and outer surfaces of the flanges of the roller structures are capable of coming into sliding contact with inner surfaces on said branches.

* * * * *